US009725994B2

(12) United States Patent
Frosell et al.

(10) Patent No.: US 9,725,994 B2
(45) Date of Patent: Aug. 8, 2017

(54) FLOW CONTROL ASSEMBLY ACTUATED BY PILOT PRESSURE

(71) Applicant: HALLIBURTON ENERGY SERVICES, INC., Houston, TX (US)

(72) Inventors: Thomas Jules Frosell, Irving, TX (US); Michael Linley Fripp, Irving, TX (US); Zachary Ryan Murphree, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 256 days.

(21) Appl. No.: 14/411,943

(22) PCT Filed: Oct. 28, 2013

(86) PCT No.: PCT/US2013/067052
§ 371 (c)(1),
(2) Date: Dec. 30, 2014

(87) PCT Pub. No.: WO2015/065313
PCT Pub. Date: May 7, 2015

(65) Prior Publication Data

US 2016/0273321 A1 Sep. 22, 2016

(51) Int. Cl.
*F15B 13/04* (2006.01)
*E21B 43/12* (2006.01)
(Continued)

(52) U.S. Cl.
CPC ..... *E21B 43/12* (2013.01); *E21B 34/02* (2013.01); *E21B 34/10* (2013.01); *E21B 37/06* (2013.01); *E21B 43/16* (2013.01)

(58) Field of Classification Search
CPC ..... Y10T 137/87193; Y10T 137/7762; Y10T 137/776; Y10T 137/7768; E21B 43/12;
(Continued)

(56) References Cited

U.S. PATENT DOCUMENTS 3,921,660 A 11/1975 Kowalski
4,036,297 A 7/1977 Swihart
(Continued)

FOREIGN PATENT DOCUMENTS

EP 1403473 1/2008

OTHER PUBLICATIONS

International Patent Application No. PCT/US2013/067052 , International Search Report and Written Opinion, mailed Jul. 17, 2014, 16 pages.

*Primary Examiner* — Jessica Cahill
(74) *Attorney, Agent, or Firm* — Kilpatrick Townsend & Stockton LLP

(57) ABSTRACT

A flow control assembly can include a pilot-operated valve and a pilot control valve. The pilot-operated valve includes a closure element between inlet port and outlet ports of the pilot-operated valve and an actuating element adjacent to the closure element. The closure element can move between an open position allowing fluid flow between the inlet and outlet ports and a closed position preventing fluid flow between the inlet and outlet ports. A pilot pressure communicated to the actuating element can cause the actuating element to apply force that moves the closure element to the open position. The pilot control valve can include a closure element between inlet port and outlet ports of the pilot control valve. Communicating an actuation pressure to the closure element of the pilot control valve can open the pilot control valve. Opening the pilot control valve can allow communication of pilot pressure to the pilot-operated valve.

20 Claims, 9 Drawing Sheets

(51) Int. Cl.

| | |
|---|---|
| ***E21B 34/10*** | (2006.01) |
| ***E21B 37/06*** | (2006.01) |
| ***E21B 34/02*** | (2006.01) |
| *E21B 43/16* | (2006.01) |

(58) Field of Classification Search
CPC ..... E21B 34/02; E21B 34/10; E21B 37/06; E21B 43/16
See application file for complete search history.

(56) References Cited

U.S. PATENT DOCUMENTS

| | | | | |
|---|---|---|---|---|
| 4,119,146 | A | 10/1978 | Taylor | |
| 4,157,167 | A | 6/1979 | Akkerman | |
| 4,220,176 | A | 9/1980 | Russell | |
| 4,254,836 | A | 3/1981 | Russell | |
| 4,308,884 | A | 1/1982 | Hoerger et al. | |
| 4,431,051 | A | 2/1984 | Adams | |
| 4,530,377 | A | 7/1985 | Peters | |
| 4,774,980 | A | 10/1988 | Etheridge | |
| 5,190,106 | A | 3/1993 | Johnston | |
| 5,213,133 | A | 5/1993 | Ellett | |
| 5,265,438 | A | 11/1993 | Knowles et al. | |
| 5,636,661 | A | 6/1997 | Moyes | |
| 6,247,536 | B1 | 6/2001 | Leismer et al. | |
| 6,296,061 | B1 | 10/2001 | Leismer | |
| 6,536,388 | B2 * | 3/2003 | Lou | F01L 9/02 123/90.12 |
| 6,575,237 | B2 | 6/2003 | Purkis et al. | |
| 6,659,184 | B1 | 12/2003 | Tips et al. | |
| 6,899,068 | B2 * | 5/2005 | Nan | F01L 9/02 123/90.12 |
| 7,007,642 | B2 * | 3/2006 | Diehl | F01L 9/02 123/90.12 |
| 7,237,472 | B2 | 7/2007 | Cove | |
| 7,503,385 | B2 | 3/2009 | Tips et al. | |
| 7,766,302 | B2 * | 8/2010 | Lou | F01L 1/462 123/90.12 |
| 8,006,768 | B2 | 8/2011 | Powell et al. | |
| 8,157,016 | B2 | 4/2012 | James | |
| 8,215,408 | B2 | 7/2012 | Yapici | |
| 8,613,264 | B2 * | 12/2013 | Gehrke | F01L 9/02 123/90.12 |
| 2007/0193639 | A1 * | 8/2007 | Ling | F01L 9/02 137/625.65 |
| 2009/0000674 | A1 | 1/2009 | Jacobsen et al. | |
| 2010/0051284 | A1 | 3/2010 | Stewart | |
| 2013/0048303 | A1 | 2/2013 | Patel et al. | |
| 2013/0055886 | A1 | 3/2013 | Park et al. | |

* cited by examiner

FLOW CONTROL ASSEMBLY ACTUATED BY PILOT PRESSURE

CROSS-REFERENCE TO RELATED APPLICATIONS

This is a U.S. national phase under 35 U.S.C. 371 of International Patent Application No. PCT/US2013/067052, titled "Flow Control Assembly Actuated by Pilot Pressure" and filed Oct. 28, 2013, the entirety of which is incorporated herein by reference.

TECHNICAL FIELD

The present disclosure relates generally to devices for use in well systems and, more particularly (although not necessarily exclusively), to flow control assemblies actuated by pilot pressure.

BACKGROUND

A well system (e.g., oil or gas wells for extracting fluids from a subterranean formation) may include injection systems or other tools that involve controlling the flow of fluids. Downhole chemical injection systems for a well system may include check valves. The check valve for a chemical injection system allows delivery of chemical fluids to the wellbore. The check valve for a chemical injection system also prevents wellbore fluids and gas from entering the control line and migrating to the surface.

Prior solutions for controlling fluid flow in injection systems and other tools may present disadvantages. For example, a chemical injection system may lack the ability to reliably prevent the flow of chemicals from the surface into the wellbore when a high differential pressure exists across a check valve of the chemical injection system.

DETAILED DESCRIPTION

Figure 1:
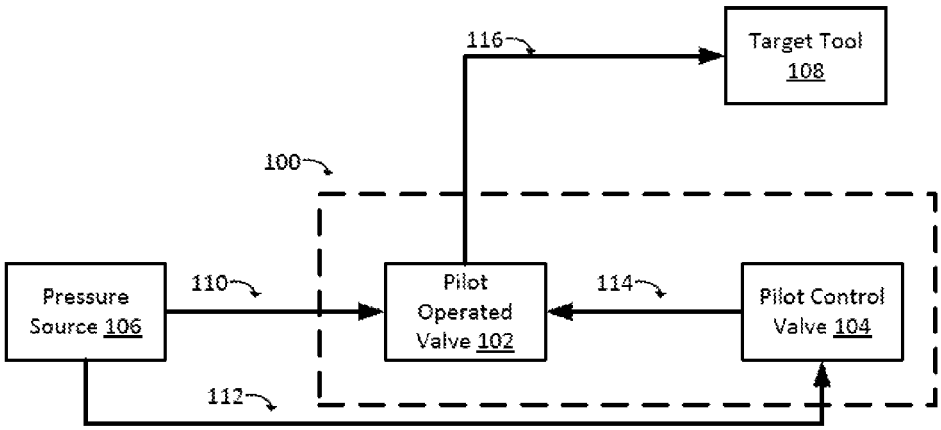
FIG. 1 is a block diagram of an example of flow control assembly actuated by a pilot pressure according to one aspect of the present disclosure.

Certain aspects and features of the present disclosure are directed to a flow control assembly actuated by a pilot pressure. The flow control assembly can include a pilot-operated valve and a pilot control valve. The pilot-operated valve can be positioned in a fluid communication path between a pressure source and a target tool. Closing the pilot-operated valve can prevent fluid from flowing between the pressure source and the target tool. The pilot-operated valve can be opened in response to a pilot pressure being communicated to the pilot-operated valve via the pilot control valve. The pilot control valve can control the pilot pressure. For example, a "cracking pressure" (i.e., an opening pressure) can be communicated from the pressure source to the pilot control valve to open the pilot control valve. Opening the pilot control valve can allow a pilot pressure to be communicated to the pilot-operated valve, thereby opening the pilot-operated valve.

In a non-limiting example, a controllable check valve assembly can be provided for a chemical injection system deployed in a wellbore. The controllable check valve assembly can include a check valve for the chemical injection system, a pilot-operated check valve, and a pilot control valve. The check valve for the chemical injection system can prevent production fluids in the inner diameter of the injection mandrel from flowing into the control line. The pilot-operated valve can be positioned between a control line and the check valve of the injection system. In the absence of a pilot pressure being communicated from the pilot control valve to the pilot-operated check valve, the pilot-operated check valve can be closed, thereby preventing fluid from flowing to the injection system's check valve from the control line. The pilot control valve can control the pilot pressure applied to the pilot-operated check valve. Applying the pilot pressure to a piston or other actuating element in the pilot-operated valve can open the pilot-operated check valve, thereby allowing a flow from the control line to the check valve for the chemical injection system.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

FIG. 1 is a block diagram of an example of flow control assembly 100 actuated by a pilot pressure according to one aspect. The flow control assembly 100 can include a pilot-operated valve 102 and a pilot control valve 104. The pressure source 106 can be used to inject fluid or otherwise communicate pressure to the target tool 108 via the flow control assembly 100. For example, injection fluid can flow from the surface or another pressure source 106 through the pilot-operated valve 102 to the target tool 108. The target tool 108 can include a check valve of a chemical injection system. The injection fluid can flow from the check valve of the chemical injection system to an injection mandrel of the chemical injection system.

The flow control assembly 100 can be positioned between a pressure source 106 and a target tool 108. The pressure source 106 can be coupled to the flow control assembly 100 via a control line or other suitable fluid communication path. Pressure can be communicated from the pressure source 106 to the pilot operated valve 102 via a fluid communication path 110. A non-limiting example of a fluid communication path 110 is a control line. Fluid can flow from the pilot operated valve 102 to a target tool 108 via a fluid communication path 116.

The pilot-operated valve 102 can be actuated by a pilot pressure communicated to the pilot-operated valve 102 via a fluid communication path 114. Actuating the pilot-operated valve 102 can switch the pilot-operated valve 102 between a closed configuration that prevents fluid from flowing to the target tool 108 and an open configuration that allows fluid to flow to the target tool 108. The pilot-operated valve 102 can be actuated by a pilot pressure communicated via the pilot control valve 104.

Figure 2:
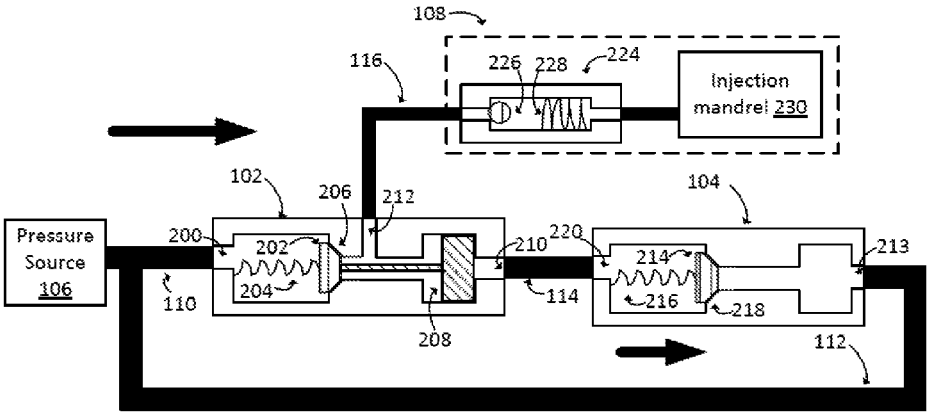
FIG. 2 is a schematic diagram of an example of a flow control assembly that includes a pilot-operated check valve and a pilot control check valve according to one aspect of the present disclosure.

In some aspects, the pilot operated valve 102 and pilot control valve 104 can be check valves. For example, FIG. 2 is a schematic diagram of an example of a flow control assembly including a pilot-operated check valve 102 and a pilot control check valve 104.

The pilot-operated check valve 102 can include an inlet port 200, a closure element 202, a pilot port 210, and an outlet port 212. Pressure can be communicated from the pressure source 106 to the inlet port 200 via the fluid communication path 110. The pilot-operated check valve 102 being in a closed configuration can include the closure element 202 being positioned to prevent fluid flow between the inlet port 200 and the outlet port 212. For example, in a closed configuration, the closure element 202 can be positioned in a seat 206. The closure element 202 being positioned in the seat 206 can prevent fluid flow from the inlet port 200 to the outlet port 212.

The pilot-operated check valve 102 can include one or more components that maintain the pilot-operated check valve 102 in a closed configuration in the absence of a pilot pressure. For example, a force can be applied to the closure element 202 in the direction of the outlet port 212 to position the closure element 202 in the seat 206, as depicted by the rightward arrow in FIG. 2. In some aspects, the force can be applied by a spring 204 or other suitable biasing component or mechanism, as depicted in FIG. 2. In other aspects, the spring 204 can be omitted and the force can be applied by the pressure communicated to the closure element via the inlet port 200.

The pilot control check valve 104 can include an inlet port 213, a closure element 214, and an outlet port 220. Pressure can be communicated to the inlet port 213 from the pressure source 106 via the fluid communication path 112. For a pilot control check valve 104 in a closed configuration, the closure element 214 can prevent fluid from flowing between the inlet port 213 and the outlet port 220. The closure element 214 can be biased against a seat 218 by a spring 216. A biasing force exerted by the spring 216 is depicted by the rightward arrow in FIG. 2

Although FIG. 2 depicts closure elements 202, 214 as poppets for illustrative purposes, any check valves with suitable closure elements can be used. In additional or alternative aspects, one or both of the pilot-operated check valve 102 and the pilot control check valve 104 can be ball valves or other suitable check valves.

In some aspects, the target tool 108 can include a check valve 224 in fluid communication with an injection mandrel 230 (depicted as a functional block in FIG. 2). The check valve 224 can include a closure element 226 and a spring 228. The closure element 226 can prevent fluid from flowing from the injection mandrel 230 in the direction of the pressure source 106.

Setting the pilot control check valve 104 to an open configuration can allow fluid to flow through the outlet port 220 of the pilot control check valve 104. Fluid flow through the pilot control check valve 104 can allow the pilot pressure to be communicated from the pilot control check valve 104 to a piston 208 of the pilot-operated check valve 102 via the pilot port 210.

Figure 3:
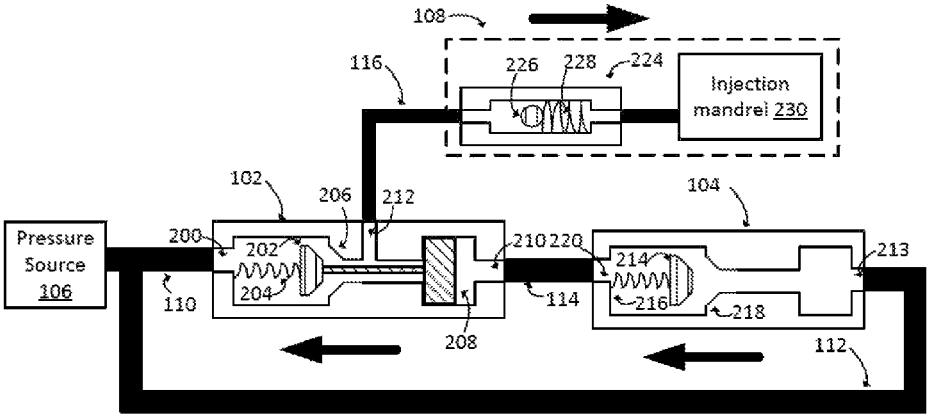
FIG. 3 is a schematic diagram of the flow control assembly of FIG. 2 that is configured to allow fluid flow through the pilot-operated check valve according to one aspect of the present disclosure.

FIG. 3 is a schematic diagram of the flow control assembly of FIG. 2 configured to allow fluid flow through the pilot-operated check valve 102 according to one aspect. The pilot control check valve 104 can be opened in response to an actuation pressure. The actuation pressure from the pressure source 106 can apply a force to the closure element 214 in the direction of the outlet port 220. An actuation pressure (or "cracking pressure") can be a pressure sufficient to overcome a biasing force applied by the spring 214.

For example, the pilot control check valve 104 may be configured such that an actuation pressure of 5,000 pounds per square inch ("psi") is required to compress the spring 216 and remove the closure element 214 from the seat 218. The actuation pressure communicated to the closure element 214 can apply a force to the closure element 214 in the direction of the outlet port 220. The force applied in the direction of the outlet port 220 can be greater than a force applied by the spring 216 in the direction of the seat 218. The closure element 214 can move away from the seat 218 in response to the force applied by the communicated pressure, as depicted by the leftward arrow below the pilot control check valve 104 in FIG. 3. The closure element 214 being moved away from the seat 218 can open the pilot control check valve 104.

Opening the pilot control check valve 104 can allow the pilot pressure to be communicated to the piston 208 via the pilot port 210. The pressure communicated to the piston 208 can apply a force to the piston 208 in the direction of the closure element 202. The force applied to the piston 208 can cause the piston 208 to contact the closure element 202. The piston 208 contacting the closure element 202 can apply a force to the closure element 202 in a direction away from the seat 206. The force applied to the closure element 202 can move the closure element 202 away from the seat 206, as depicted by the leftward arrow below the pilot-operated check valve 102 in FIG. 3. Although FIGS. 2-3 depict a piston 208 used to apply force to the closure element 204, any actuating element suitable for applying the force to the closure element 202 can be used.

Moving the closure element 202 away from the seat 206 can allow fluid to flow through the pilot-operated check valve 102 from the inlet port 200 to the outlet port 212.

Fluid flowing though the pilot-operated check valve 102 can allow pressure to be communicated from the pressure source 106 to the target tool 108. For example, pressure can be communicated to the check valve 224 of the target tool 108. The pressure communicated to the check valve 224 can apply a force to the closure element 226 that moves the closure element 226 against the spring 228, as depicted by the rightward arrow in FIG. 3. Moving the closure element 226 against the spring 228 can open the check valve 224, thereby allowing fluid flow through the check valve 224. Fluid flow through the check valve 224 can allow an injection pressure to be communicated to the injection mandrel 230.

The pilot-operated check valve 102 can be closed by reducing the injection pressure communicated from the pressure source 106 to a level below the actuation pressure. Reducing the injection pressure to a level below the actuation pressure can allow the springs 204, 216 to expand and thereby move the respective closure elements 202, 214 against the respective seats 206, 218. The closure element 202 moving against the seat 206 can expel fluid from the inner volume to the pilot-operated check valve 102.

Expelling fluid from the inner volume to the pilot-operated check valve 102 can communicate pressure to the fluid communication path 114. In some aspects, the pressure in the fluid communication path 114 can be relieved by using a pilot control check valve 104 that is configured to allow a leakage of pressure from the fluid communication path 114 to the fluid communication path 112. For example, after closing the pilot control check valve 104, pilot pressure in the fluid communication path 114 can leak through the pilot control check valve 104 from the outlet port 220 to the inlet port 213.

Figure 4:
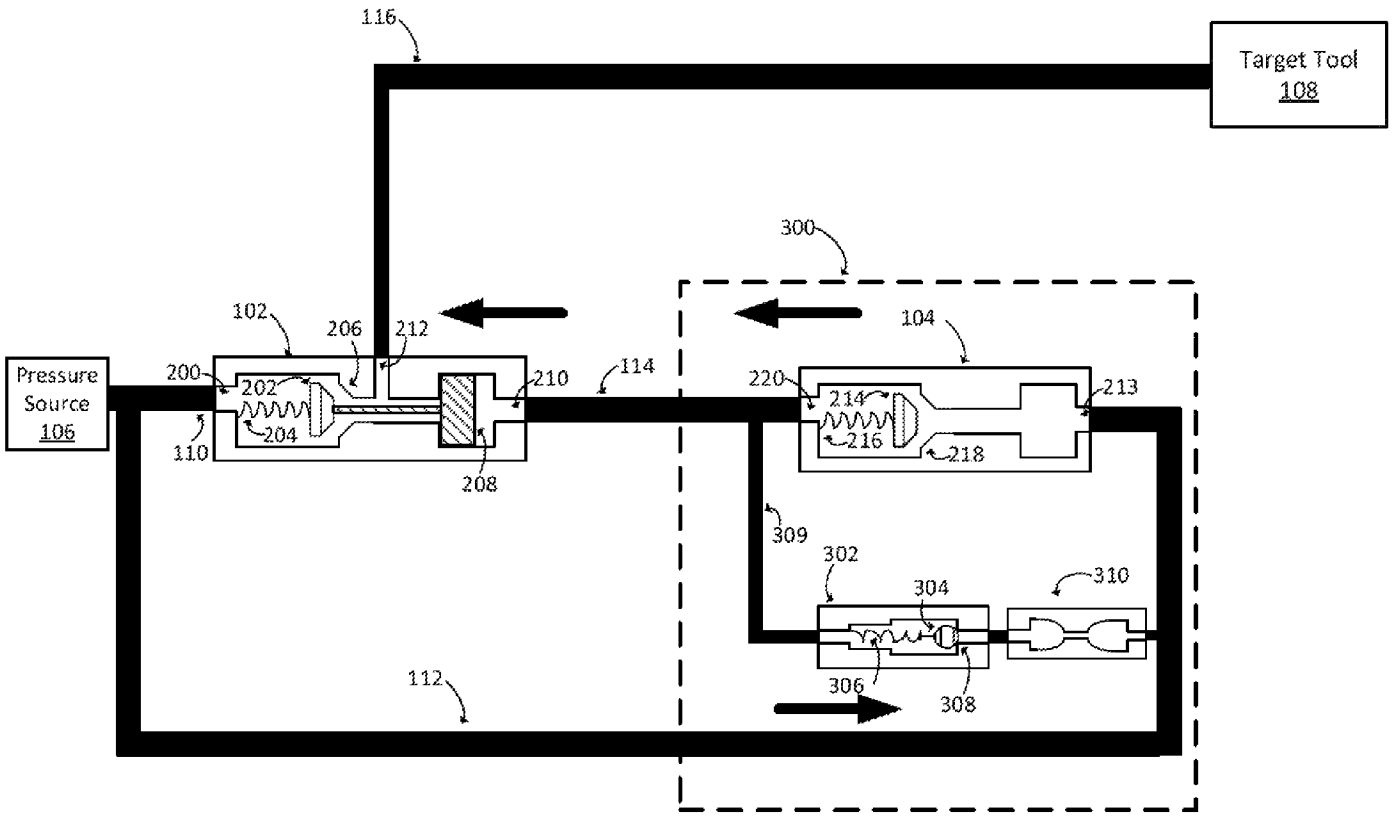
FIG. 4 is a schematic diagram of a flow control assembly that includes a pilot control sub-assembly with a relief valve for relieving pilot pressure according to one aspect of the present disclosure.
Figure 5:
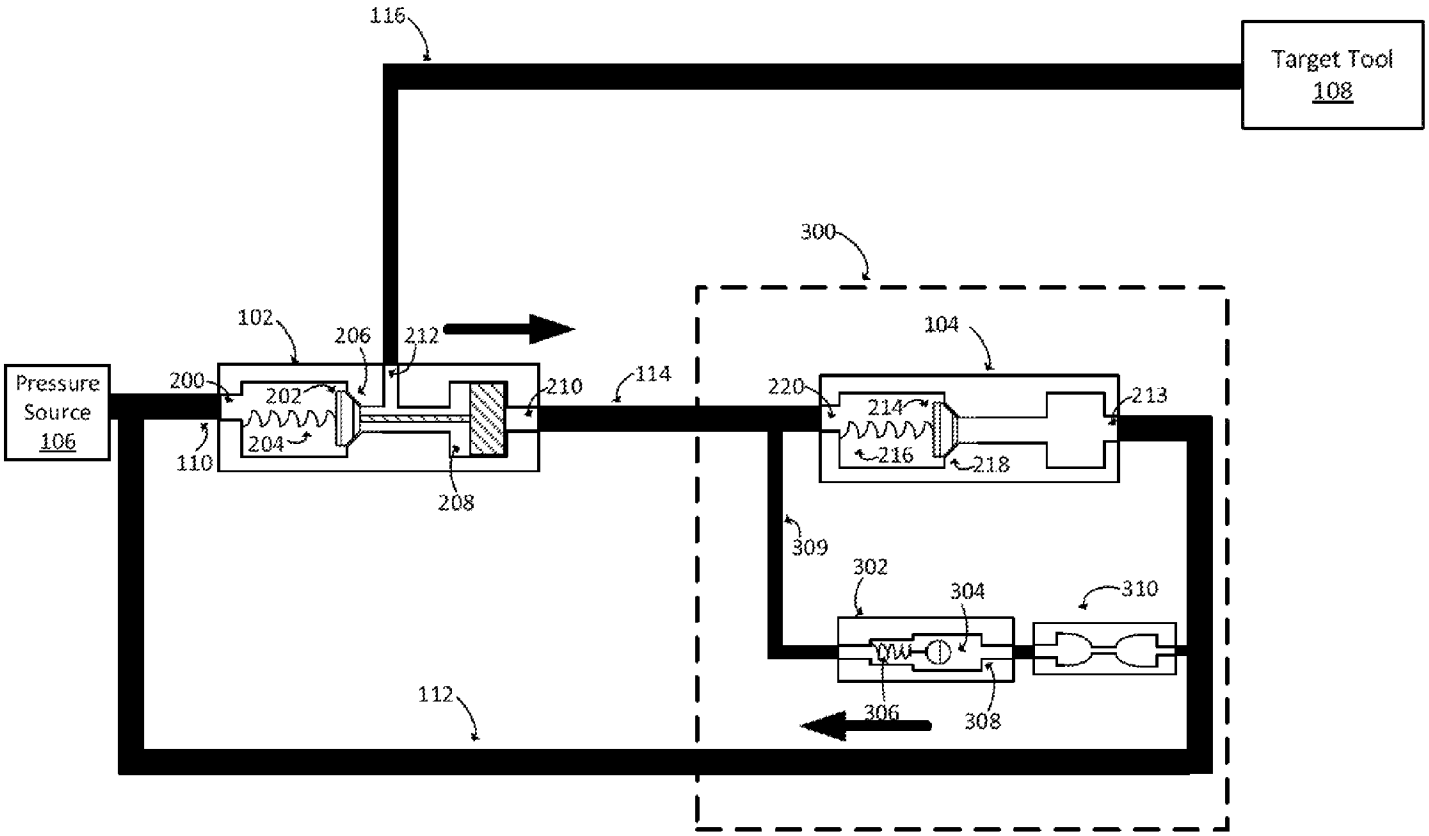
FIG. 5 is a schematic diagram of the flow control assembly of FIG. 4 configured to relieve pilot pressure according to one aspect of the present disclosure.

In additional or alternative aspects, the flow control assembly 100 can include one or more components for relieving the pressure in the fluid communication path 114 caused by ceasing the pilot pressure. For example, FIGS. 4-5 schematically depict a flow control assembly that includes a pilot control sub-assembly 300 with a relief valve 302 and a restrictor 310. Opening the relief valve 302 can allow pilot pressure in the fluid communication path 114 to be relieved in response to the pilot control check valve 104 being closed. The restrictor 310 can include any component or device that can control a rate at which fluid flows out of the relief valve 302.

The relief valve 302 can be closed in response to the pilot pressure being communicated through the fluid communication path 114 at sufficiently high pressure levels (i.e., an actuation pressure of the pilot control check valve 104). Pressure can be communicated from the fluid communication path 114 to the relief valve 302 via a fluid communication path 309. The relief valve 302 can include a closure element 304 and a spring 306. A pressure in the fluid communication path 309 at or above the actuation pressure (e.g., 5,000 psi) can cause a force to be applied to the closure element 304 in the direction of the seat 308, as depicted by the rightward arrow in FIG. 4. The force applied to the closure element 304 can extend the spring 306, thereby allowing the closure element 304 to be positioned in the seat 308, as depicted in FIG. 4. The closure element 304 being positioned in the seat 308 can close the relief valve 302.

The relief valve 302 can be opened in response to the pressure being communicated through the fluid communication path 114 being lower than the actuation pressure (e.g., less than 5,000 psi). The spring 306 can have a sufficient tension that the spring 306 contracts for pressures in the fluid communication path 114 that are lower than the actuation pressure. The contraction of the spring 306 can apply a force to the closure element 304 that moves the closure element 304 away from the seat 308, as depicted by the leftward arrow in FIG. 5. Moving the closure element 304 away from the seat 308 can allow fluid from the fluid communication path 114 to flow through the fluid communication path 309 and the relief valve 302. The restrictor 310 can control the rate at which fluid flows out of the relief valve 302.

Although the relief valve 302 is depicted in FIGS. 4-5 as including a spring 306 that extends in response to the pressure in the fluid communication path 114 being at the pilot pressure for illustrative purposes, other implementations are possible. For example, in some aspects, a spring in a relief valve 302 can apply a force to a closure element 304 in the direction of an inlet of the relief valve 302. The relief valve 302 can open in response to the pressure in fluid communication path 114 being greater than the pressure in the fluid communication path 112.

Figure 6:
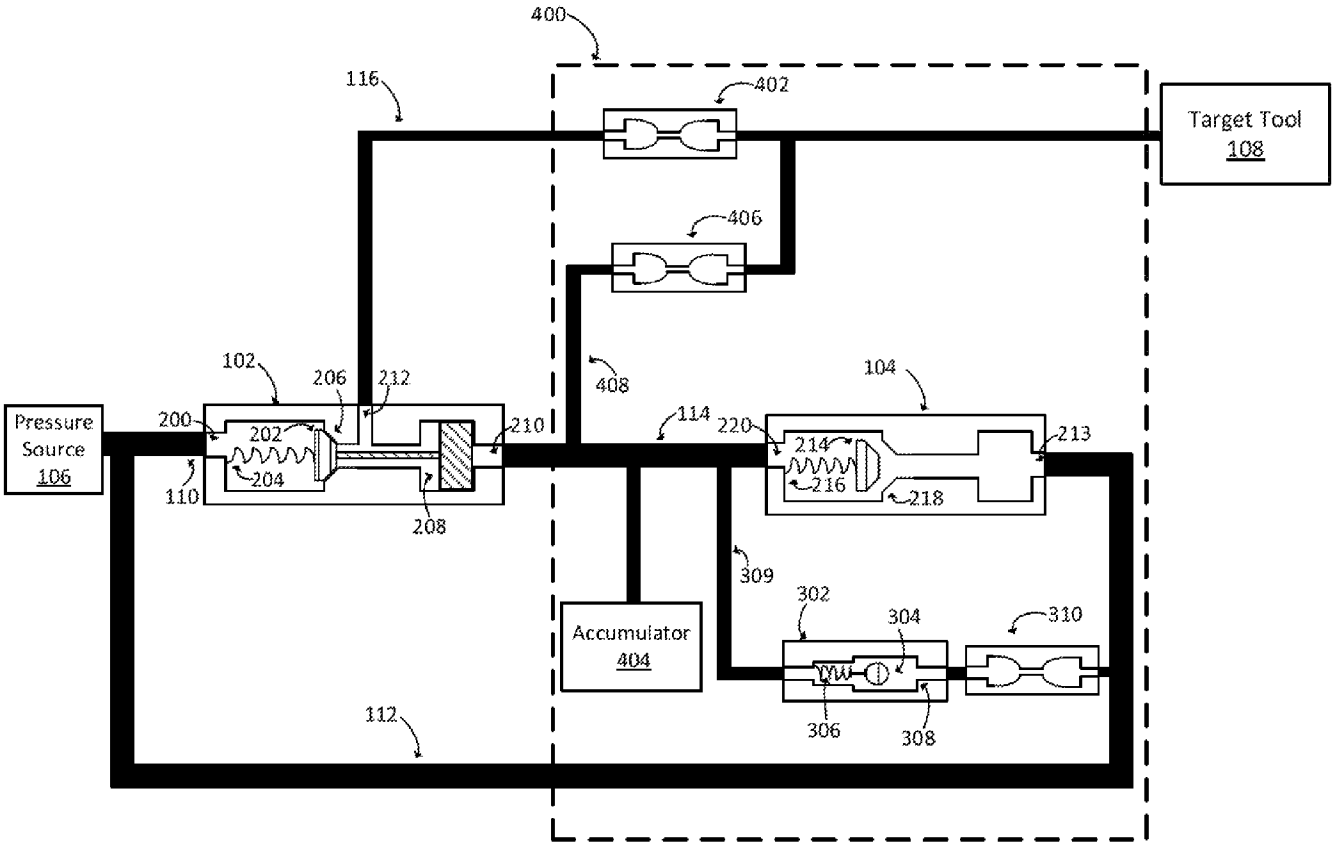
FIG. 6 is a schematic diagram of a flow control assembly that includes a pilot control sub-assembly with additional components for regulating fluid flow according to one aspect of the present disclosure.

In additional or alternative aspects, the flow control assembly can be configured to provide additional fluid control functions. For example, FIG. 6 is a schematic diagram of a flow control assembly including a pilot control sub-assembly 400 with additional components for regulating fluid flow according to one aspect. The pilot control sub-assembly 400 can include the pilot control check valve 104, the relief valve 302, the restrictor 310, restrictors 402, 406, and an accumulator 404.

The restrictor 402 can be positioned in a fluid communication path 116 between the pilot-operated check valve 102 and the target tool 108. Fluid can flow from the pilot-operated check valve 102 through the restrictor 402 to the target tool 108. The restrictor 402 can control a rate at which fluid flows through the pilot-operated check valve 102.

Controlling a rate at which fluid flows through the pilot-operated check valve 102 can reduce or prevent disruptions in the pilot pressure to the pilot-operated check valve 102. For example, prior to opening the pilot-operated check valve 102, a pressure differential may exist between the inlet port 200 and the outlet port 212. The pressure differential may be sufficiently large that opening the pilot-operated check valve 102 causes a sudden pressure drop in the fluid communication path 110. A pressure drop in the fluid communication path 110 may cause a corresponding pressure drop in the fluid communication path 112 between the pressure source 106 and the pilot control check valve 104. A pressure drop in the fluid communication path 112 may cause a disruption in the communication of pilot pressure to the pilot-operated check valve 102. The restrictor 402 in the fluid communication path 116 can cause fluid to flow through an open pilot-operated check valve 102 at a rate that is sufficient to reduce or prevent sudden pressure drops in the fluid communication paths 110, 112.

The accumulator 404 can reduce or prevent fluctuations in pressure communicated via the fluid communication path 114. For example, the accumulator 404 can be in fluid communication with the fluid communication path 114. Fluid can flow from the fluid communication path 114 into the accumulator 404. A compressible element in the accumulator 404 can be compressed in respond to fluid flowing into the accumulator 404. A drop in pressure in the fluid communication path 114 can cause the compressible element in the accumulator 404 to expand. Expansion of the compressible element in the accumulator 404 can expel the stored fluid from the accumulator 404 to the fluid communication path 114. Expelling the stored fluid from the accumulator 404 to the fluid communication path 114 can compensate for the drop in pressure in the fluid communication path 114.

The restrictor 406 can be positioned in a fluid communication path 408 between the fluid communication path 114 and the target tool 108. Fluid can flow from the pilot control check valve 104 through the restrictor 406 to the target tool 108. The restrictor 406 can prevent the pilot-operated check valve 102 from opening in response to pressure leaking through the pilot control check valve 104. For example, a leaked pressure that leaks through the pilot control check valve 104 may be less than an actuation pressure for opening the pilot control check valve 104 and greater than or equal to a pilot pressure used for opening the pilot-operated check valve 102. Leaked fluid from the pilot control check valve 104 can flow from the fluid communication path 408 to the target tool 108 via the restrictor 406. A flow of leaked fluid from the fluid communication path 408 to the target tool 108 via the restrictor 406 can prevent premature opening of the pilot-operated check valve 102.

In some aspects, the pilot control sub-assembly 400 can include the relief valve 302, and the restrictors 310, 406. In other aspects, including the restrictor 406 can allow the relief valve 302 and restrictor 310 to be omitted. Fluid from the fluid communication path 114 can flow through the restrictor 406 and out of the fluid communication path 114 in response to a closure of the pilot control check valve 104

Figure 7:
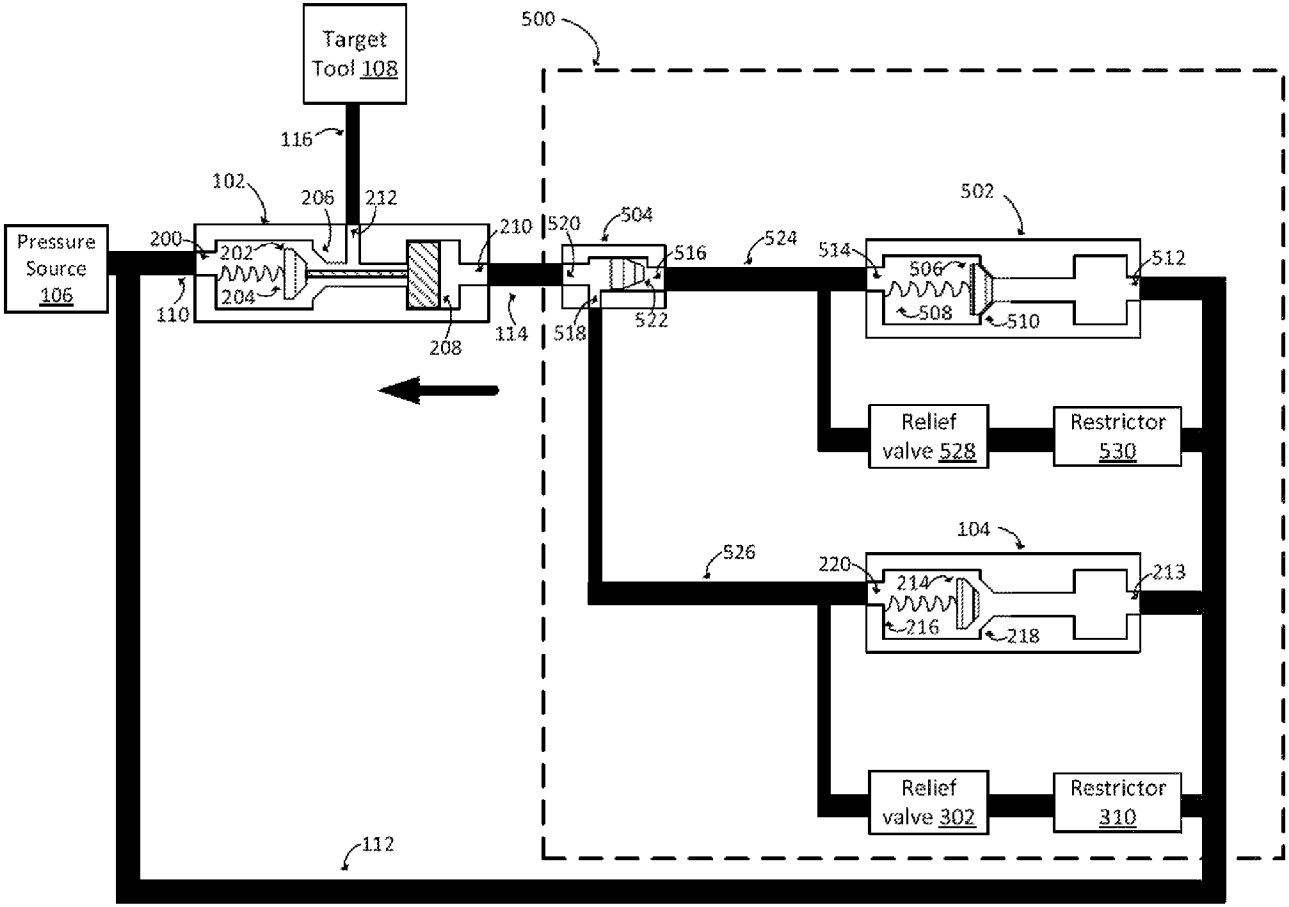
FIG. 7 is a schematic diagram of a flow control assembly including a pilot control sub-assembly for allowing fluid flow in a range of injection pressures according to one aspect of the present disclosure.

In additional or alternative aspects, the flow control assembly can be configured to allow pressure injection to the target tool 108 at a range of injection pressures. For example, FIG. 7 is a schematic diagram of a flow control assembly including a pilot control sub-assembly 500 for allowing fluid flow in a range of injection pressures. The pilot control sub-assembly 500 can allow fluid to flow from the pressure source 106 to the target tool 108 for injection pressures in a range from a lower threshold pressure to an upper threshold pressure.

The pilot control sub-assembly 500 can include the pilot control check valve 104, an additional pilot control valve 502, and a bypass valve 504. In some aspects, the pilot control sub-assembly 500 can also include relief valves 302, 528 and restrictors 310, 530 (depicted as functional blocks in FIG. 7). The relief valve 528 and restrictor 530 can provide a pressure relief function for the pilot control check valve 502 in a manner similar to that of relief valve 302 and restrictor 310 as described above with respect to FIGS. 4-5. In other aspects, the pilot control sub-assembly 500 can omit one or more of the relief valves 302, 528 and the restrictors 310, 530.

The pilot control check valve 104 can open in response to a pressure at or above the lower threshold pressure being communicated to the inlet port 213, as described above with respect to FIGS. 2-3. For example, the pilot control check valve 104 may be configured to open in response to a pressure of 4,000 psi being communicated to the inlet port 213 of the pilot control check valve 104. For injection pressures in a pressure range from the lower threshold pressure to the upper threshold pressure, fluid can flow from the outlet port 220 of the pilot control check valve 104 via a fluid communication path 526 to a port 518 of the bypass valve 504. A closure element 522 can be positioned such that the bypass valve 504 is open, thereby allowing fluid to flow between the ports 518, 520 of the bypass valve 504. Fluid can flow from the outlet port 520 of the bypass valve 504 to the pilot port 210 of the pilot-operated check valve 102. Fluid flowing to the pilot port 210 can allow pilot pressure to be communicated to the piston 208, as depicted by the leftward arrow in FIG. 7. The pilot pressure communicated to to the piston 208 can open the pilot-operated check valve 102, as described above with respect to FIGS. 2-3.

The pilot control check valve 502 can open in response to a pressure at or above the upper threshold pressure being communicated to the inlet port 512. For example, the pilot control check valve 502 may be configured to open in response to a pressure of 5,000 psi being communicated to an inlet port 512 of the pilot control check valve 502. The pilot control check valve 502 can include a closure element 506 biased against a seat 510 by a spring 508. Pressure can be communicated to the closure element 506 via the inlet port 512. An injection pressure at or above the upper threshold pressure level (e.g., 5,000 psi) can move the closure element 506 away from the seat 510, thereby opening the pilot control check valve 502. Opening the pilot control check valve 502 can allow fluid to flow from an outlet port 514 of the pilot control check valve 502 to an inlet port 516 of the bypass valve 504 via the fluid communication path 524. Fluid flow from the pilot control check valve 502 to the bypass valve 504 can communicate pressure to the closure element 522 of the bypass valve 504.

Figure 8:
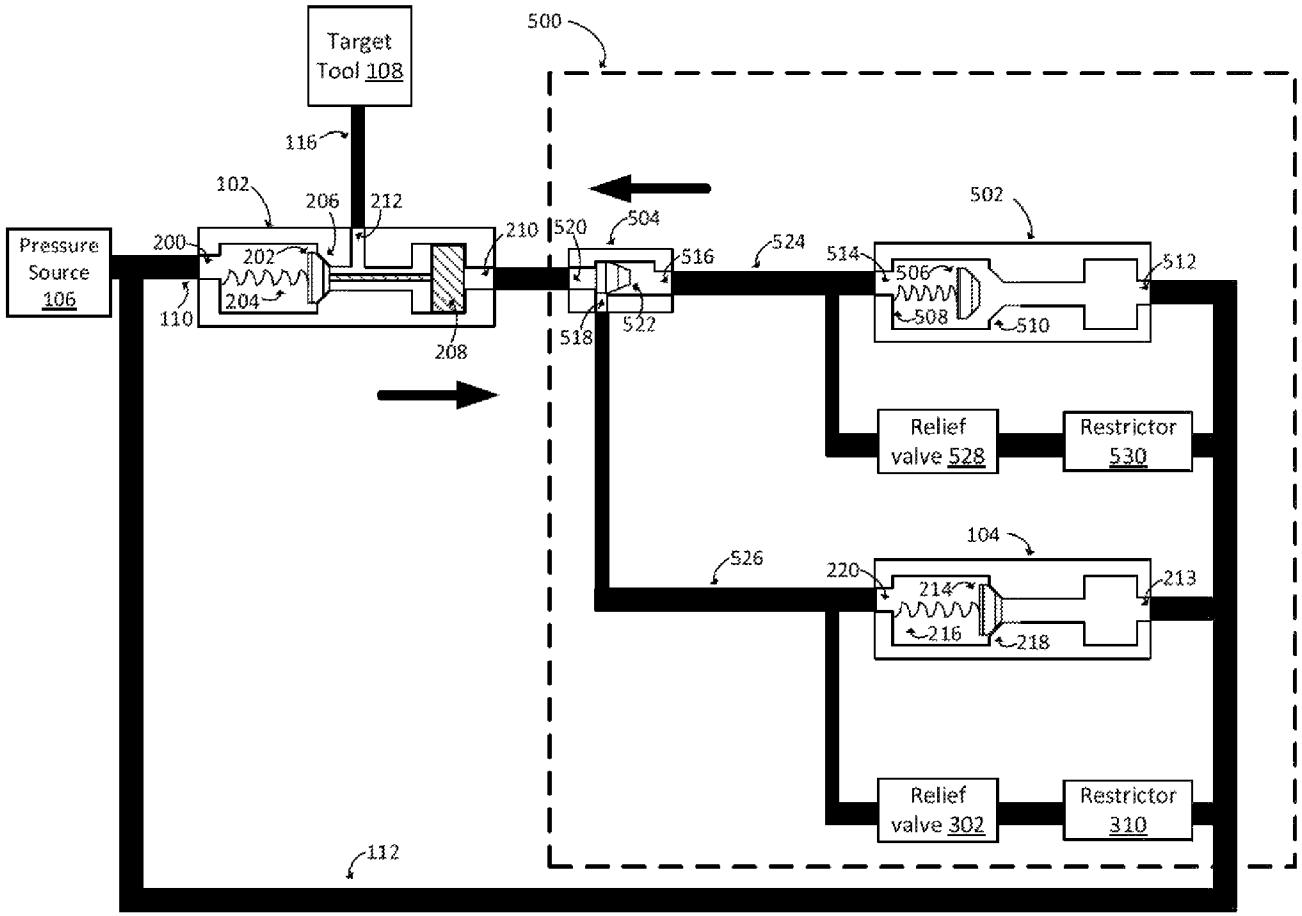
FIG. 8 is a schematic diagram of the flow control assembly of FIG. 7 configured to prevent fluid flow at or above an upper threshold injection pressure according to one aspect of the present disclosure.

FIG. 8 depicts the bypass valve 504 being closed in response to pressure being communicated from the pilot control check valve 502 to the bypass valve 504. Pressure communicated to the closure element 522 can apply a force to the closure element 522 in the direction of the outlet port 520, as depicted by the leftward arrow in FIG. 8. The force applied to the closure element 522 in the direction of the outlet port 520 can move the closure element 522 to a position that prevents fluid flow between ports 518, 520, thereby closing the bypass valve 504.

Closing the bypass valve 504 can cease communication of pilot pressure via the pilot control check valve 104 to the pilot-operated check valve 102. The closure element 202 can move to a closed position in response to a cessation of pilot pressure, thereby closing the pilot control check valve 104 as described above with respect to FIGS. 2-3. The direction of movement for the closure element 202 and the piston 208 are depicted by the rightward arrow in FIG. 8.

Although FIGS. 2-8 depict a pilot control check valve opened in response to a pressure differential between the fluid communication paths 112, 114 (e.g., a differential between a control line pressure and the pilot pressure), other implementations are possible. In additional or alternative aspects, a pilot control valve can be opened in response to a pressure differential between the fluid communication paths 114, 116.

Figure 9:
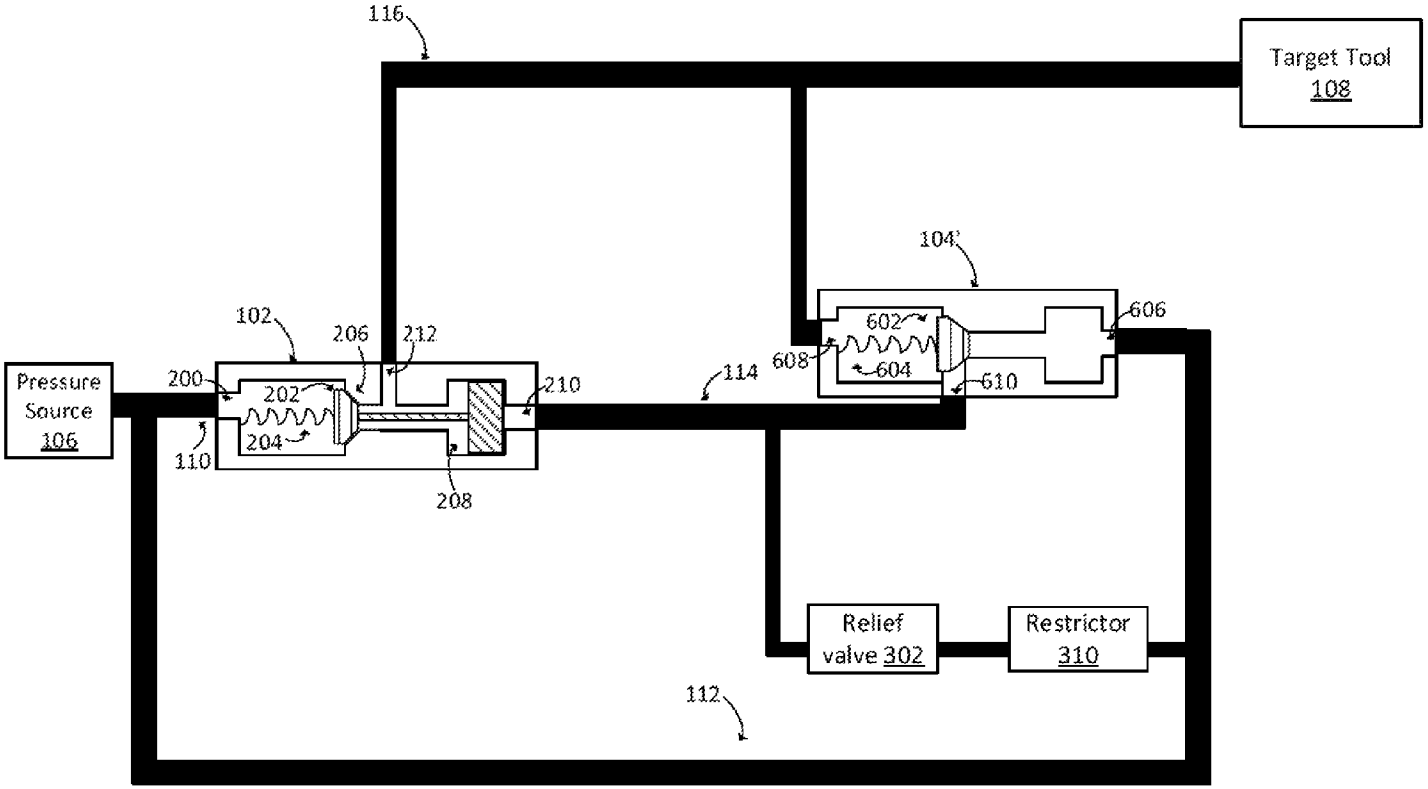
FIG. 9 is a schematic diagram of a flow control assembly including an alternative pilot control valve according to one aspect of the present disclosure.

For example, FIG. 9 is a schematic diagram of a flow control assembly including an alternative pilot control valve 104' according to one aspect. The pilot control valve 104' can include a closure element 602 biased by a spring 604, an inlet port 606, a reference port 608, and an outlet port 610. The inlet port 606 can be in fluid communication with the pressure source 106 via a control line or other suitable fluid communication path 112. The reference port 608 can be in fluid communication with the fluid communication path 116 to the target tool 108. The pilot control valve 104' can be actuated using a differential pressure between the inlet port 606 and the reference port 608.

In a non-limiting example, a pressure at the reference port 608 may be a pressure of a tubing string in which the target tool 108 is deployed. A pressure at the inlet port 606 can be a control line pressure communicated via the fluid communication path 112. The tubing string pressure at the reference port 608 being greater than the control line pressure at the inlet port 606 can prevent the pilot control valve 104' from being opened. The tubing string pressure at the reference port 608 being less than the control line pressure at the inlet port 606 can allow the pilot control valve 104' to be opened. Opening the pilot control valve 104' can allow the pilot pressure to be communicated to the pilot-operated check valve 102.

Figure 10:
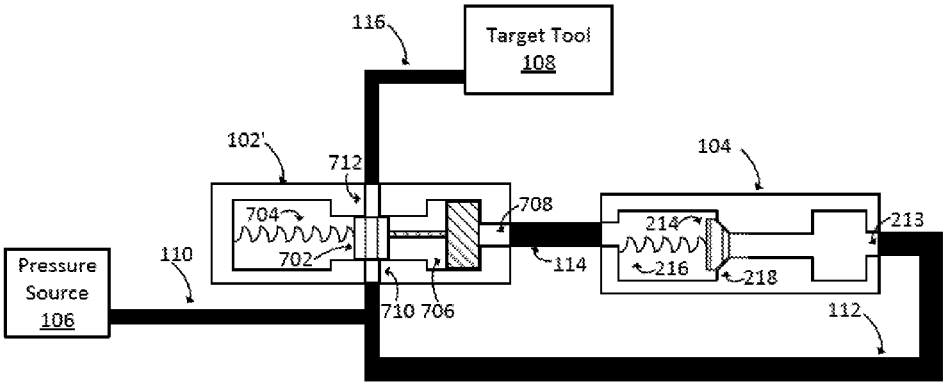
FIG. 10 is a schematic diagram of an example of a flow control assembly including an alternative pilot-operated valve according to one aspect of the present disclosure.

Although FIGS. 2-9 depict a pilot operated valve 102 that is a check valve, any suitable pilot operated valve can be used. For example, FIG. 10 is a schematic diagram of an example of a flow control assembly including an alternative pilot-operated valve 102'. The pilot-operated valve 102' can include a closure element 702 and a piston 706. The piston 706 can be adjacent to the closure element 702. The closure element 702 can be positioned between an inlet port 710 and an outlet port 712 of the pilot-operated valve 102'. The closure element 702 being positioned between the inlet port 710 and the outlet port 712 can prevent fluid flow between the pressure source 106 and the target tool 108. In some aspects, a spring 704 can apply a force to the closure element 702 that positions the closure element 702 between the inlet port 710 and the outlet port 712. In other aspects, the spring 704 can be omitted.

Figure 11:
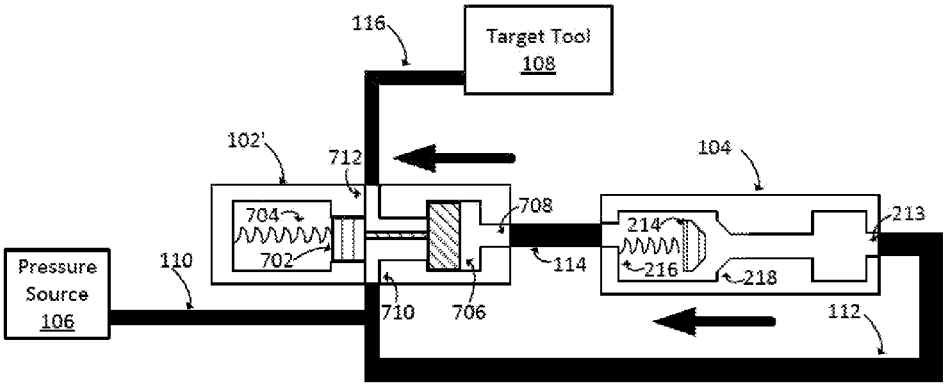
FIG. 11 is a schematic diagram of the flow control assembly of FIG. 10 configured to allow fluid flow through the pilot-operated valve according to one aspect of the present disclosure.

FIG. 11 depicts the pilot-operated valve 102' being opened. Opening the pilot control check valve 104 can allow a pilot pressure to be communicated to the piston 706 via the pilot port 708. The pilot pressure communicated to the piston 706 can apply a force to the piston 706, as depicted by the leftward arrow in FIG. 11. The applied force can cause the piston 706 to apply a force to the closure element 702. The force applied to the closure element 702 can move the closure element 702 away from the ports 710, 712. Moving the closure element 702 away from the ports 710, 712 can allow fluid to flow from the pressure source 106 through the inlet port 710 and the outlet port 712 to the target tool 108.

The disclosure above describes flow control assemblies actuated by pilot pressure. In some aspects, a flow control assembly is provided. The flow control assembly can include a pilot-operated valve and a pilot control valve or other control valve. The pilot-operated valve can include a closure element positioned between an inlet port and an outlet port and an actuating element adjacent to the closure element. A non-limiting example of an actuating element is a piston. The closure element of the pilot-operated valve can be moved between an open position that allows fluid flow between the inlet and outlet ports and a closed position that prevents or restricts fluid flow between the inlet and outlet ports. The actuating element can be moved in response to communication of a pilot pressure to the actuating element via a pilot port of the pilot-operated valve. The closure element of the pilot-operated valve can be moved to the open position in response to a force applied by movement of the actuating element. The control valve can include a closure element positioned between inlet and outlet ports of the control valve. In some aspects, the inlet ports of both the pilot-operated valve and the control valve can be connected to a common pressure source. The closure element of the control valve can be moved to an open position that allows fluid flow between the inlet and outlet ports of the control valve in response to communication of an actuation pressure to the closure element. The control valve can allow communication of the pilot pressure to the pilot port in response to the closure element of the control valve being in the open position.

In some aspects, the pilot-operated valve can be a check valve. The check valve can allow fluid flow from the inlet port to the outlet port of the pilot-operated valve. The check valve can prevent or restrict fluid flow from the outlet port to the inlet port of the pilot-operated valve.

In some aspects, the control valve can be a check valve. The check valve can allow fluid flow from the second inlet port to the second outlet port. The check valve can prevent or restrict fluid flow from the second outlet port to the second inlet port. In other aspects, the control valve can include a reference port that can be connected to a fluid communication path from the outlet port of the pilot-operated valve to a target tool. The closure element of the control valve can be moved in response to a pressure at the second inlet port exceeding a pressure at the reference port.

In additional or alternative aspects, the flow control assembly can include a fluid communication path between the pilot port and the second outlet port and a relief valve. The relief valve can include an inlet port in fluid communication with the fluid communication path and a closure element. The closure element of the relief valve can be moved between an open position that allows fluid flow through the inlet port of the relief valve and a closed position that prevents or restricts fluid flow through the inlet port of the relief valve. The closure element of the relief valve can be moved to the closed position in response to a closing pressure being communicated to the closure element. The closing pressure can be equal to or otherwise correspond to the pilot pressure that is communicated from the control valve to the pilot-operated valve via the fluid communication. The closure element of the relief valve can be moved to the open position in response to a pressure being communicated to the closure element that is greater than an opening pressure for the relief valve and less than the closing pressure. In some aspects, the flow control assembly can also include a restrictor in fluid communication with an outlet port of the relief valve. The restrictor can restrict a flow of fluid out of the fluid communication path between the pilot port and the second outlet port.

In some aspects, the flow control assembly can also include a fluid communication path between the pilot port and the outlet port of the control valve and a restrictor that is in fluid communication with the fluid communication path.

In some aspects, the flow control assembly can also include a restrictor in fluid communication with the outlet port of the pilot-operated valve. The restrictor can restrict a fluid flow from the outlet port of the pilot-operated valve by a specified amount of restriction.

In some aspects, the flow control assembly can also include a fluid communication path between the pilot port and the outlet port of the control valve, a bypass valve positioned in the fluid communication path between the pilot-operated valve and the control valve, and an additional control valve. The bypass valve can include a bypass closure element that can be moved from an open position that allows fluid flow through the bypass valve to the control valve and a closed position that prevents or restricts fluid flow through the bypass valve to the control valve. The additional control valve can include a closure element positioned between inlet port and outlet ports of the additional control valve. The outlet port of the additional control valve can be in fluid communication with the bypass closure element. The closure element of the additional control valve can be moved to an open position that allows fluid flow through the inlet and outlet ports of the additional control valve and to the bypass closure element in response to an additional actuation pressure being communicated to the closure element. The additional actuation pressure can be greater than the actuation pressure for the control valve. The bypass closure element can be moved to the closed position in response to pressure communicated to the bypass closure element by the fluid flow to the bypass valve from the outlet port of the additional control valve. In some aspects, the inlet ports of the control valve and the additional control valve can be connected to a common pressure source.

The foregoing description of the disclosure, including illustrated aspects and examples has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure. Aspects and features from each example disclosed can be combined with any other example.

What is claimed is:

1. A flow control assembly comprising:

a pilot-operated valve comprising:

a first closure element positioned between a first inlet port and a first outlet port of the pilot-operated valve, the first closure element movable between an open position allowing fluid flow between the first inlet and outlet ports and a closed position preventing fluid flow between the first inlet and outlet ports, and an actuating element adjacent to the first closure element, the actuating element movable in response to communication of a pilot pressure to the actuating element via a pilot port of the pilot-operated valve, wherein the first closure element is movable to the open position in response to a force applied by movement of the actuating element; and a control valve comprising a second closure element positioned between a second inlet port and a second outlet port of the control valve, wherein the second closure element is movable to an open position allowing fluid flow between the second inlet and outlet ports in response to communication of an actuation pressure through the second inlet port to the second closure element, wherein the control valve is operable for allowing the communication of the pilot pressure to the pilot port in response to the second closure element being in the open position.

2. The flow control assembly of claim 1, wherein the first inlet port and the second inlet port are connectable to a common pressure source.

3. The flow control assembly of claim 1, further comprising a fluid communication path between the pilot port and the second outlet port; and a relief valve comprising:

a third inlet port in fluid communication with the fluid communication path, and a third closure element selectively movable from an open position allowing fluid flow through the third inlet port and a closed position preventing fluid flow through the third inlet port, wherein the third closure element is movable to the closed position in response to a closing pressure being communicated to the third closure element, the closing pressure corresponding to the pilot pressure being communicated from the control valve to the pilot-operated valve via the fluid communication, and wherein the third closure element is movable to the open position in response to a pressure greater than an opening pressure and less than the closing pressure being communicated to the third closure element.

4. The flow control assembly of claim 3, further comprising a restrictor in fluid communication with a third outlet port of the relief valve, the restrictor operable for restricting a flow of fluid out of the fluid communication path between the pilot port and the second outlet port.

5. The flow control assembly of claim 1, further comprising:

a fluid communication path between the pilot port and the second outlet port; and a restrictor in fluid communication with the fluid communication path.

6. The flow control assembly of claim 1, further comprising a restrictor in fluid communication with the first outlet port of the pilot-operated valve, the restrictor operable for restricting a fluid flow from the first outlet port of the pilot-operated valve by a specified amount of restriction.

7. The flow control assembly of claim 1, further comprising:

a fluid communication path between the pilot port and the second outlet port;

a bypass valve positioned in the fluid communication path between the pilot-operated valve and the control valve, the bypass valve comprising a bypass closure element movable from an open position allowing fluid flow through the bypass valve to the control valve and a closed position preventing fluid flow through the bypass valve to the control valve; and an additional control valve comprising a third closure element positioned between a third inlet port and a third outlet port of the additional control valve, wherein the third outlet port is in fluid communication with the bypass closure element, wherein the third closure element is movable to an open position allowing fluid flow between the third inlet port and the third outlet port to the bypass closure element in response to an additional actuation pressure being communicated to the third closure element, wherein the additional actuation pressure is greater than the actuation pressure for the control valve, wherein the bypass closure element is movable to the closed position in response to pressure communicated to the bypass closure element by the fluid flow from the third outlet port to the bypass valve.

8. The flow control assembly of claim 7, wherein the second inlet port of the control valve and the third inlet port of the additional control valve are connectable to a common pressure source.

9. The flow control assembly of claim 1, wherein the pilot-operated valve comprises a first check valve operable for allowing fluid flow from the first inlet port to the first outlet port and preventing fluid flow from the first outlet port to the first inlet port;

wherein the control valve comprises a second check valve operable for allowing fluid flow from the second inlet port to the second outlet port and restricting fluid flow from the second outlet port to the second inlet port.

10. The flow control assembly of claim 1, wherein the control valve further comprises a reference port connectable to a fluid communication path from the first outlet port of the pilot-operated valve to a target tool, wherein the second closure element is movable in response to a first pressure at the second inlet port exceeding a second pressure at the reference port.

11. A flow control assembly comprising:

a pilot-operated check valve comprising:

a first closure element positioned between a first inlet port and a first outlet port of the pilot-operated check valve, the first closure element movable between an open position allowing fluid flow from the first inlet port to the first outlet port and a closed position preventing fluid flow from the first outlet port to the first inlet port, and an actuating element adjacent to the first closure element, the actuating element movable in response to communication of a pilot pressure to the actuating element via a pilot port of the pilot-operated check valve, wherein the first closure element is movable to the open position in response to a force applied by movement of the actuating element; and a pilot control check valve comprising a second closure element positioned between a second inlet port and a second outlet port of the pilot control check valve, wherein the second closure element is movable to an open position allowing fluid flow from the second inlet port to the second outlet port in response to communication of an actuation pressure through the second inlet port to the second closure element, wherein the pilot control check valve is operable for allowing the communication of the pilot pressure to the pilot port in response to the second closure element being in the open position.

12. The flow control assembly of claim 11, wherein the first inlet port and the second inlet port are connectable to a common pressure source.

13. The flow control assembly of claim 11, further comprising a fluid communication path between the pilot port and the second outlet port; and a relief valve comprising:

a third inlet port in fluid communication with the fluid communication path, and a third closure element selectively movable from an open position allowing fluid flow through the third inlet port and a closed position preventing fluid flow through the third inlet port, wherein the third closure element is movable to the closed position in response to a closing pressure being communicated to the third closure element, the closing pressure corresponding to the pilot pressure being communicated from the pilot control check valve to the pilot-operated check valve via the fluid communication, and wherein the third closure element is movable to the open position in response to a pressure less than the closing pressure being communicated to the third closure element.

14. The flow control assembly of claim 13, further comprising a restrictor in fluid communication with a third outlet port of the relief valve, the restrictor operable for restricting a flow of fluid out of the fluid communication path between the pilot port and the second outlet port.

15. The flow control assembly of claim 11, further comprising:

a fluid communication path between the pilot port and the second outlet port; and a restrictor in fluid communication with the fluid communication path, the restrictor operable for allowing a controlled fluid flow from the fluid communication path in response to a pressure lower than the pilot pressure being communicated from the second outlet port to the pilot port.

16. The flow control assembly of claim 11, further comprising a restrictor in fluid communication with the first outlet port of the pilot-operated check valve, the restrictor operable for restricting a fluid flow from the first outlet port of the pilot-operated check valve to a specified flow rate.

17. The flow control assembly of claim 11, further comprising:

a fluid communication path between the pilot port and the second outlet port;

a bypass valve positioned in the fluid communication path between the pilot-operated check valve and the pilot control check valve, the bypass valve comprising a bypass closure element movable from an open position allowing fluid flow through the bypass valve to the pilot control check valve and a closed position preventing fluid flow through the bypass valve to the pilot control check valve; and an additional pilot control check valve comprising a third closure element positioned between a third inlet port and a third outlet port of the additional pilot control check valve, wherein the third outlet port is in fluid communication with the bypass closure element, wherein the third closure element is movable to an open position allowing fluid flow between the third inlet port and the third outlet port to the bypass closure element in response to an additional actuation pressure being communicated to the third closure element, wherein the additional actuation pressure is greater than the actuation pressure for the pilot control check valve, wherein the bypass closure element is movable to the closed position in response to pressure communicated to the bypass closure element by the fluid flow from the third outlet port to the bypass valve.

18. The flow control assembly of claim 17, wherein the second inlet port of the pilot control check valve and the third inlet port of the additional pilot control check valve are connectable to a common pressure source.

19. The flow control assembly of claim 11, wherein the pilot-operated check valve is connectable to a pressure source and further comprising a check valve operable for allowing fluid flow from the pressure source to an injection mandrel and preventing fluid flow the injection mandrel to the pressure source, wherein the first outlet port of the pilot-operated valve is in fluid communication with the check valve.

20. An assembly for controlling injection of fluid to an injection mandrel, the assembly comprising:

a check valve operable for allowing fluid flow from a pressure source to the injection mandrel and preventing fluid flow the injection mandrel to the pressure source;

a pilot-operated valve comprising:

a first closure element positioned between a first inlet port connectable to the pressure source and a first outlet port in fluid communication with the check valve, the first closure element movable between an open position allowing fluid flow between the pressure source and the check valve and a closed position preventing fluid flow between the pressure source and the check valve, and an actuating element adjacent to the first closure element, the actuating element movable in response to communication of a pilot pressure to the actuating element via a pilot port of the pilot-operated valve, wherein the first closure element is movable to the open position in response to a force applied by movement of the actuating element; and a pilot control valve comprising a second closure element positioned between a second inlet port connectable to the pressure source and a second outlet port in fluid communication with a pilot port of the pilot-operated valve, wherein the second closure element is movable to an open position allowing fluid flow between the second inlet and outlet ports in response to communication of an actuation pressure through the second inlet port to the second closure element, wherein the pilot control valve is operable for allowing the communication of the pilot pressure to the pilot port in response to the second closure element being in the open position.

* * * * *